US005609001A

United States Patent [19]

Pantaloni et al.

[11] Patent Number: 5,609,001

[45] Date of Patent: Mar. 11, 1997

[54] MODULAR INSULATING UPHOLSTERY FOR CLOSED CHAMBER

[75] Inventors: Jacques R. Pantaloni, Marseilles; Roger L. Martin, La Gavotte, both of France

[73] Assignee: Enthalpy S.A., Marseilles, France

[21] Appl. No.: 295,730

[22] PCT Filed: Jan. 8, 1993

[86] PCT No.: PCT/FR93/00018

§ 371 Date: Aug. 26, 1994

§ 102(e) Date: Aug. 26, 1994

[87] PCT Pub. No.: WO93/18335

PCT Pub. Date: Sep. 16, 1993

[30] Foreign Application Priority Data

Mar. 9, 1992 [FR] France ..... 92 03070

[51] Int. Cl.[6] ..... E04B 1/74

[52] U.S. Cl. ..... 52/506.02; 52/506.05; 52/506.09; 52/309.9; 52/783.19; 52/269; 220/423; 220/470

[58] Field of Search ..... 52/511, 506.02, 52/506.04, 506.05, 506.09, 793.1, 794.1, 309.4, 309.9, 783.19, 267, 269, 411, 745.01, 745.13, 746.1; 220/421, 423, 424, 448, 445, 470

[56] References Cited

U.S. PATENT DOCUMENTS

| | | | |
|---|---|---|---|
| 1,795,613 | 3/1931 | Moehle | 220/448 X |
| 1,800,713 | 4/1931 | Bowersock | 220/448 X |
| 1,942,162 | 1/1934 | Campbell . | |
| 2,175,948 | 10/1939 | Adams . | |
| 2,833,001 | 5/1958 | Montefalco | 52/506.05 X |
| 2,962,323 | 11/1960 | McBride | 52/794 X |
| 3,112,043 | 11/1963 | Tucker . | |
| 3,226,899 | 1/1966 | Blickle | 52/506.05 |
| 3,229,441 | 1/1966 | Heffner | 52/481.1 X |
| 3,393,920 | 7/1968 | Eltruch | 52/762 X |
| 4,284,683 | 8/1981 | Hipchen et al. . | |
| 4,497,859 | 2/1985 | Baumann | 220/448 X |
| 5,105,970 | 4/1992 | Malone et al. | 220/470 X |
| 5,143,245 | 9/1992 | Malone | 220/470 X |
| 5,154,309 | 10/1992 | Wischusen | 220/470 X |

FOREIGN PATENT DOCUMENTS

| | | | |
|---|---|---|---|
| 000581 | 12/1979 | European Pat. Off. | 52/309.9 |
| 1465383 | 1/1967 | France . | |
| 948206 | 1/1964 | United Kingdom . | |

OTHER PUBLICATIONS

Parsec Thermobrite System 2 pages from PARSEC Corporation Catalog File 1989.

*Primary Examiner*—Robert Canfield
*Attorney, Agent, or Firm*—Ladas & Parry

[57] ABSTRACT

Modular insulating upholstery for a closed chamber (7) consisting of panels (1, 2) and prefabricated elements, specially suited to chambers for the transport of goods such as containers. The panels and prefabricated elements form part of an assembly set or kit adaptable to the dimensions of the chamber interior (7) to be insulated and comprise all the necessary upholstering elements. The panels (1) covering the chamber peripheral walls and ceiling consist of a self-supporting sheer insulator in one piece. The prefabricated elements essentially comprise spacing units (6) in the form of small blocks, which are placed between the inner chamber surface and at least the outer panel surfaces, and are made of a material capable of breaking any thermal conduction between the two surfaces.

13 Claims, 2 Drawing Sheets

MODULAR INSULATING UPHOLSTERY FOR CLOSED CHAMBER

BACKGROUND

The present invention relates to a modular insulating upholstery for closed chambers.

The technical sector of the invention is the field of the manufacture of insulating material adapted to walls.

One of the main applications of the invention is the production of upholstery specially designed for heat-insulating the wails of chambers intended for transporting goods such as maritime, road, rail or aircraft wagons or containers.

Indeed, the devices known and produced heretofore are most of the time made "in situ", inside the chamber of the container or inside the volume to be insulated, by assembly of various insulating elements, stiffeners or inserts which need to be adjusted on the spot to the inside dimensions of the chamber, this taking a long time and requiring a highly qualified workmanship. Moreover, once the upholstery has been installed, it is impossible to check whether the elements situated at the back of the visible inner panels have been correctly fitted.

Yet, all the elements are necessary, to obtain an efficient insulation of the upholstery, and if one is missing or incorrectly mounted, it will not give the expected performances, and the goods stored in the chamber in question can then be damaged.

Different devices are also known, which devices are adapted for various other uses, and make it possible to solve this problem of efficiency of insulation which is necessary for the use in question, while eliminating the need for a complex implementation "in situ": these systems are indeed produced from prefabricated, removable, modular panels, such as those described in patent application FR 2 660 060 of Mar. 23, 1990 of the company SART INDUSTRIE, relating to a "thermal chamber designed to work at high temperature, and constituted of non-jointed and removable modular panels, each one comprising an external metal plate provided with a refractory system on its face turned towards the inside of the chamber"; also noted is patent application FR 2 623 172 filed on Nov. 16, 1987 by Mr. K. JAN ALAIN for "wine vats composed of insulating structural composite panels" delivered in kit form and making it particularly possible, according to the inventor, to obtain an advantageous saving on transport and handling costs; in another field of application, there is also noted the patent application EP 90810521 filed on Jul. 11, 1989 by the company WELK ELEKTRA INGENIERIE CORPORATION LIMITED for a "method and device for producing hollow modular panels and the panels thus obtained", essentially used for heat insulation and designed for refrigerator inner liners; finally, there is noted patent EP 82900926 filed on Mar. 24, 1982 by Bureau d'Etudes et de Constructions Industrialisées SABECI for a "system of storey-type metallic industrialized building, with elements finished in the workshop", comprising sound and heat insulating panellings and various other modular elements enabling all types of building construction.

It is thus obvious that for every particular application and every type of insulation, it is necessary to develop upholstering devices and/or insulating panels corresponding to each one of these applications.

In the field related to closed chambers, such as in particular those intended for transporting goods, which is the main object of the present invention, no modular elements have been known or used until today, since most of the chambers in question are not of absolutely standard dimensions, and are not initially designed to receive such upholstery. Consequently, the methods and devices used heretofore are implemented "in situ", inside the chamber in question, such as indicated hereinabove, and from elements in plate form and stiffeners adapted for the transport of goods, and indeed requiring a good strength and insulation with respect to the outside chamber which is often in metal.

There can be noted in this field the patent of Etablissements DAHER & Cie filed on Jul. 17, 1986 under No. 2 601 752 and relating to an "insulating panel for inside lining of a volume intended for transporting goods"in order to attain the aforesaid objects, namely their positioning inside a chamber and their resistance with respect to the goods and their adaptation to the stresses imposed by use, the panels described in this patent are characterized by the combination of supports constituted by spacer-stiffeners, defining between them intercalated gaps, and receiving metal sheets stretched over kraft paper and plated on a strong continuous flat surface, which latter receives new spacer-stiffeners applied against a second adjacent rigid surface in synthetic resin with interposed air blades, and forming via a metal sheet also stretched over kraft paper, the inner wall of the volume protected by two new stiffeners in contact with the goods.

This does show that such an assembly effected in situ, which requires a superposition of elements to be adapted to the dimensions of the chamber, takes a long time and requires a qualified staff, without any definite guarantee, once the assembly is completed, of the reliability of the insulation, due to the fact that once everything has been mounted, access to the first element deposited against the first surface of the inside chamber to be insulated, is impossible.

The problem arising is therefore to be able to insulate different existing chambers, and in particular chambers intended for transporting goods, by using an insulating modular upholstery which can be fitted by non-specialized staff, very quickly and economically, without any risk of omitting one of the essential elements of the insulation and with the possibility of adapting itself to various types of chambers in ranges of standard dimensions, even approximately of identical values.

SUMMARY OF THE INVENTION

One solution to the arising problem is an insulating modular upholstery for closed chambers, constituted of prefabricated panels and elements, said prefabricated panels and elements forming part of an assembly set, commonly called "kit" adaptable to the dimensions of the inside of the chamber to be insulated, and comprising all the elements necessary for the upholstering, said panels covering the peripheral walls and the ceiling of the chamber being constituted of a self-supporting monobloc insulating material in plate form, and said prefabricated elements essentially comprising spacers in the form of small blocks, placed between the internal surface of the chamber and the external surfaces of said panels, and produced in a material capable of breaking any thermal conduction between said two surfaces.

According to a preferred embodiment, said plates constituting the panel are covered over at least one of their faces with a material forming a reflecting surface.

Preferably, said plates are symmetrical and reversible with two reflecting faces.

According to another preferred embodiment, said panels are of standard dimensions and the spacers which are placed between the panels covering the ceiling, and said ceiling, are constituted of flexible blocks which compensate for the variations of height and which can be slid into place after the assembly of said panels.

According to a preferred embodiment, said spacers concerning the lateral peripheral walls are twin-face, self-adhesive patches in supple material.

The result is new types of insulating modular upholstery for closed chamber, particularly intended for transporting goods, such as maritime, road, rail or aircraft wagons or containers solving the arising problem, and eliminating the disadvantages noted in the currently used upholsteries and methods.

Indeed, it enables non-specialized staff to install very quickly and economically an insulating upholstery in which any defects can be detected a posteriori by simple visual examination. Indeed, the method for producing an insulting modular upholstery or padding according to the present invention and comprising the aforementioned characteristics is such that:

the spacers are fixed on the lateral walls of the chamber to be equipped, in a number at least equal to three for each panel;

said insulating panels covering the lateral peripheral walls are applied against said spacers;

then the ceiling panels are slid above said lateral panels, the length of the ceiling panels being equal to the width of the chamber, so that said ceiling panels can be placed astride on the upper ends of said lateral panels;

then said ceiling panels are stabilized by spacers interposed between said panels and said ceiling;

then the supple insulating sheet and the insulating floor panels are laid without any fixing means, and said upholstery is completed by any prefabricated element composing the assembly set and enabling said insulation to be completed.

Thus, according to a preferred embodiment comprising all the characteristics ensuring maximum insulation from the upholstery, said latter is constituted of an assembly set or kit adapted to the dimensions of the container or of the chamber to be equipped comprising, on the one hand, a series of reversible modular insulating self-supporting panels with two reflecting surfaces, flat joint covers and corner joint covers, rear panels likewise modular, the assembly being pre-cut in the factory and, on the other hand, prefabricated assembly elements or accessories composed of flexible blocks and twin-face self-adhesive patches.

Thus, said self-supporting plate-shaped monobloc insulating panels no longer require any stiffeners to ensure their positioning and to hold them in position: only spacers, keeping them apart from the internal surface of the chamber to be insulated are sufficient to ensure a break of conduction between the wall of said chamber and the panel elements; said spacers are thus punctual of the type forming groups of studs or small blocks, preferably self-adhesive, in order to ensure quick installation thereof, without the need of any particular tools.

Moreover, said insulating panels are preferably coated at least on one face with one and preferably two film-type reflecting materials so as to ensure a symmetry to the panel in such a way that, whatever the direction in which the member of staff will fix the panel, a good continuity of the reflecting screens and of the tightness brought by the joint covers, is guaranteed.

Moreover, having optimum standard panels which are adaptable to the lateral and upper walls of the chamber in the case of containers which are, a priori, of the same range of basic dimensions, and of generally square cross-section, but which, from one container to another, can differ and require at the moment an adapted assembly in situ, said ceiling spacers can then be blocks which compensate for the variations of dimensions by their suppleness, or any device which adapts to small variations of height: which latter can indeed be of several centimeters on the inside.

Thus, by combining all the aforesaid elements and prefabricating them, by eliminating the stiffeners, by the prefabrication and modularity, and the absence of gluing of the different plate-shaped components, it is possible to obtain a very quick positioning method which only requires, as this has been tested, only about half an hour for one person in a twenty feet standard container, whereas until now, it was necessary to use two persons for four hours to obtain a result which in spite of all was not necessarily reliable and was difficult to control visually once completed.

Other advantages of the present invention could be cited, but those mentioned hereinabove are already sufficient to show the novelty and advantage thereof.

BRIEF DESCRIPTION OF THE DRAWING

The following description and figures illustrate an of embodiment of the invention, but they are not in any way restrictive: other embodiments are possible within the scope and extent of the present invention, particularly by changing the nature and the type of material constituting the different elements.

DETAILED DESCRIPTION

Figure 1:
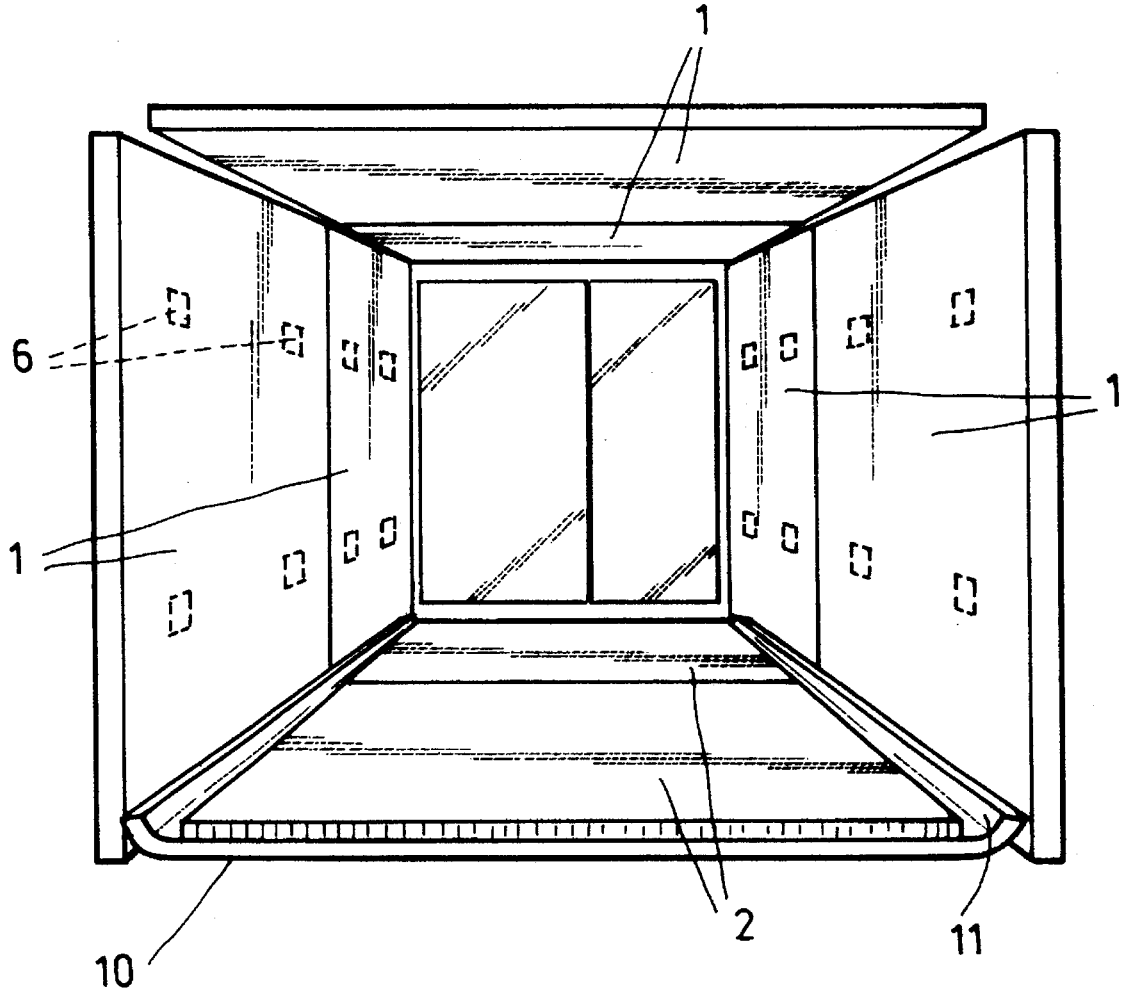
FIG. 1 is a perspective front view of a closed chamber, particularly of the maritime container type which is the example retained in the following description, as being more adapted to the present invention, but other types of chambers can be equipped with the same type of upholstery.

The insulating modular upholstery according to the invention and such as illustrated in the accompanying figures, for closed chamber, and more particularly for transporting containers, is constituted of insulating panels 1 for the peripheral lateral walls and the ceiling, of insulating floor panels 2, and of complementary prefabricated elements, permitting both fitting of said panels and a better insulation, such as in particular the flat joint covers 3 and the corner joint covers 4, and different types of spacers 5, 6, such as defined hereinafter.

Indeed, in the present invention, said panels 1, 2 and the prefabricated elements form part of an assembly set or "kit" adaptable to the dimensions of the inside of the chamber 7 to be insulated and comprising all the elements necessary for the upholstering; said panels 1 which cover the peripheral walls and the ceiling of the chamber, are constituted of a quadrangular self-supporting monobloc plate of insulating material, and said prefabricated elements comprise essentially spacers 5, 6 in the form of punctual blocks, placed between the internal surface of the chamber 7 and the external surfaces of said panel 1, and produced in a material capable of breaking any thermal conduction between said two surfaces.

Said plates constituting the panel 1 are covered on at least one of their faces with a film-type material or paint producing a reflecting surface, and preferably, they are symmetrical and reversible with a double reflecting face.

In order to standardize the manufacture and to simplify the assembly, the insulating panels 1 especially in the case of containers of square cross-section are of identical length and about the same width as the sides and the ceiling of the chamber 7. They are of standard width, for example substantially equal to 1.20 m corresponding to a normal manufacture, hence economical. Their length is slightly less than the height of the chamber to be equipped.

Figure 2:
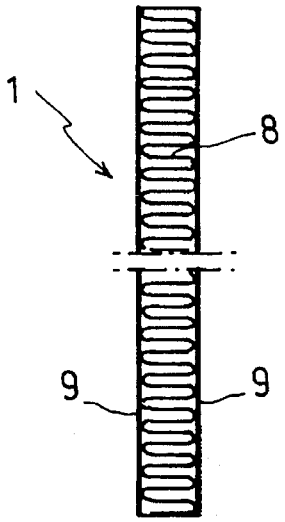
FIG. 2 is a cross-sectional view of an insulating self-supporting panel for lateral walls and ceiling.

According to FIG. 2, each panel 1 is formed of a core 8 constituted of a plate of about 10 cm thickness in a semi-rigid cellular material, such as expanded polystyrene, molded continuously or discontinuously, or formed of a honeycomb style assembly of material such as cardboard, covered on each one of its faces with a reflecting screen 9 which is smooth and preferably shiny, and which can be an aluminum-plated polyester film applied on grey kraft paper, or a complex of aluminum sheet of 1 μm thickness applied on kraft paper, or even a shiny paint, and in this case, said panels are covered with an intermediate cardboard type base making it possible to receive said paint.

The panels 1 are self-supporting and preferably symmetrical, this making it possible to place them in any direction without any problem and without the risk of mistaking the direction. Their constitution enables them to adapt easily to the differences of inside dimensions of containers, which differences may be quite wide with respect to standard average dimensions.

The structure of monobloc panels in self-supporting plate form eliminates the need to use stiffeners for holding the reflecting sheets, the panel and the insulating material as required in the currently used techniques. According to the present invention, the essential requirement is to have spacers 6 between said panels and the chamber to be insulated, so as to constitute a break of conduction between the wall which is often metallic of the outer chamber, and the reflecting wall of the insulating panel.

Figure 3:
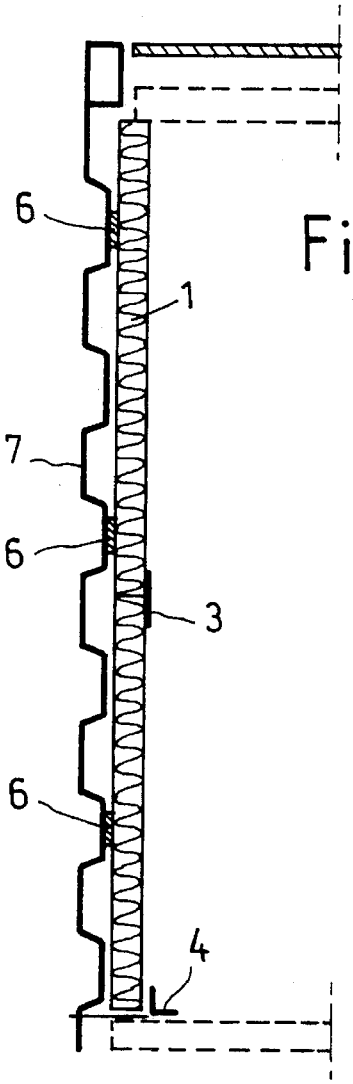
FIG. 3 is a partial horizontal section of a maritime type container equipped with insulating panels such as illustrated in FIG. 1.

Concerning the peripheral lateral walls, said spacers 6 are preferably twin-face self-adhesive patches of supple material, which can be applied firstly against the chamber proper up to 3 or 4 per panel for example, and which receive the insulating panels 1, abutting against their adhesive face at the required distance from the chamber as illustrated in FIGS. 1 and 3.

Figure 4:
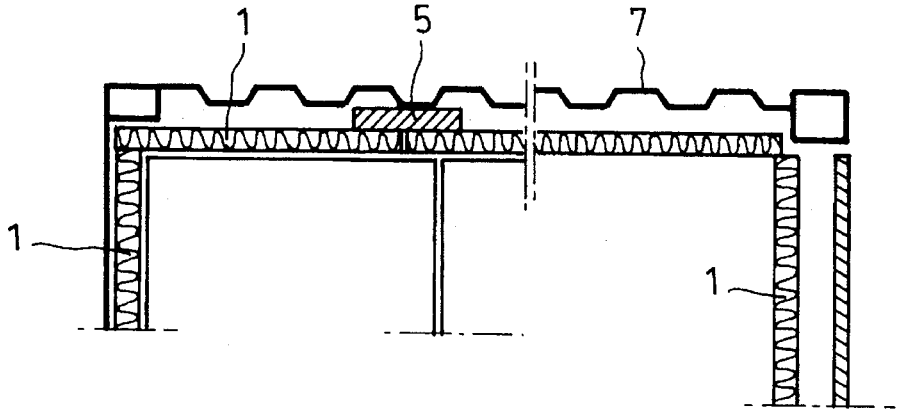
FIG. 4 is a partial vertical section of a maritime container as shown in FIG. 3, likewise equipped with self-supporting panels such as illustrated in FIG. 1.

Concerning the panels 1 covering the ceiling, in order to be able to make good the differences in dimensions of the inside heights of said closed volumes, said spacers 6 are slid in once the ceiling panels have been positioned, as illustrated in FIG. 4, and they are placed between said panels 1 and the ceiling: they are constituted of flexible blocks 5 which compensate for said variations of dimensions. Thus, the roof or ceiling panels, whose length is equal to the width of the container, which width is equal to the height in the most widely used types, are laid astride on the upper ends and stabilized by means of said flexible blocks 5, which can be produced in plastic foam adhesively applied on cardboard or other materials enabling them to be slid in while retaining their suppleness and their elastic efficiency.

The air tightness of the lateral walls and of the ceiling or roof is then ensured by covering the joints between the insulating panels 1 whose edges are supposed to touch, with self-adhesive strips, which are flat 3 or preformed 4 for the angles and which are packed in rolls in order to be cut on demand.

Concerning the panels 2 covering the floor of the chamber 7, these are laid preferably on a sheet 10 of tight and supple material, such as a polyan film of 12 to 200 hundredths of millimeters thickness for example, applied over the whole surface of the floor, and intended to ensure air and water tightness and on which are then preferably laid the panels 2. These are constituted for example of two sheets of polystyrene 11 of about 2 millimeters thickness and having an aluminum type reflecting film adhesively applied on one face and of a plate of woodfiber of about 3.2 millimeters thickness: they can have the same width as the lateral insulating panels 1 and a length enabling them to be inserted between the lateral insulating panels while providing at their end a passage for a slight lifting up of the polyan sheet 10, the surface of which is then greater than that of the floor which it covers and optionally than that of the polystyrene sheets 11.

Said sheet 10 of supple material which can be not only of polyan but also in polypropylene of the type used for tarpaulins, thus ensures a continuous tightness on the periphery by its deformation against the walls.

The floor panels 2 are constituted preferably of thin layers, such that they can remain supple, while supporting heavy loads to ensure the transport of the goods inside, while ensuring a minimum of insulation which may however be of lesser efficiency than the lateral surfaces, since the floor is less exposed to thermal exchanges.

All the elements which are thus pre-dimensioned and necessary to produce an insulating upholstery are packed in packages of standard panels and, depending on the case, in packages of panels of non-standard adjustable width, so as to be adaptable to different types of dimensions. The necessary number of such packages, to which will be added the fitting accessories, form a complete assembly set or "kit", which is delivered on a throw-away pallet. Indeed, such a type of upholstery, because of its standardization and of the relatively low value of the material constituting it, can be disposed of after each use and thus considerably simplify the use of the containers whose destination can be changed while being, on demand, either insulating or simply transporters without insulation by instant removal of the upholstery: this can then be thrown away on the spot of the conversion or changed after use and normal wear.

This is all the easier and possible to produce as the fitting is completed in a very short time and requires no specialized staff, thus permitting very important reductions of the cost price.

The positioning of the different constituting elements give to the device according to the invention a maximum of useful effects which had not been obtained until now with similar devices.

What is claimed is:

1. The combination comprising modular insulating means and a closed chamber having peripheral walls, a ceiling and a floor, the closed chamber having standardized dimensions for said walls, ceiling and floor, said modular insulation means comprising a plurality of prefabricated insulating panels which are dimensioned to cover the walls, ceiling and floor of the closed chamber, and a plurality of spacer blocks of substantially smaller size than said panels, said spacer blocks being interposed between said panels and said peripheral walls and ceiling of the closed chamber to maintain said panels in spaced relation from said peripheral walls and said ceiling, said spacer blocks being made of a material which is substantially thermally nonconductive, said panels comprising quadrangular plates which are self-supporting and made of an insulating material, a plurality of said panels being installed in said closed chamber in adjacent, juxtaposed relation to one another opposite said walls and said ceiling, the panels having dimensions to enable a number of the panels to be individually and separately mounted on any of the walls, ceiling and floor of the closed chamber to collectively cover the walls, ceiling and floor such that a modular assembly of the panels on the walls, ceiling and floor of the closed chamber can be carried out, in situ, within the closed chamber.

2. The combination as claimed in claim 1, wherein said plates constituting the panels have at least one face covered with a material producing a reflecting surface.

3. The combination as claimed in claim 2, wherein said plates are symmetrical and reversible with double reflecting faces.

4. The combination as claimed in claim 1, wherein said panels are of standardized dimensions and the spacer blocks between the ceiling and the panels covering said ceiling, are constituted of flexible material which compensate for variations in height inside the closed chamber and can be slid into place after assembly of said panels on said walls and said ceiling.

5. The combination as claimed in claim 1, wherein said chamber has a floor which is covered by a number of said panels with an intervening sheet of supple and tight material.

6. The combination as claimed in claim 1, wherein said spacer blocks between the peripheral walls and said panels have twin-face self-adhesive patches of supple material.

7. The combination as claimed in claim 1, further comprising joint-covering flat adhesive strips for covering joints between adjacent side by side panels and pre-formed adhesive strips for covering angle joints between adjacent panels at an angle to one another.

8. The combination as claimed in claim 1, wherein said insulating panels each comprises a core of a semi-rigid cellular material, or expanded polystyrene or honeycomb cardboard and thin, outer covers on opposite faces of said core.

9. The combination as claimed in claim 1, wherein said chamber has a height and width which are substantially equal, said insulating panels being of identical length slightly less than the height of the chamber.

10. A method of insulating a closed chamber having peripheral walls, a ceiling and a floor, the closed chamber having standardized dimensions for said walls, ceiling and floor, said method comprising:

attaching a plurality of spacer blocks to the peripheral walls of the closed chamber, securing insulating panels to said spacer blocks opposite said peripheral walls of the closed chamber to cover said peripheral walls, each of said panels being formed by prefabricating a self-supporting monoblock plate of thermally insulative material to the dimensions of said closed chamber, each panel being secured to the respective said wall by at least three of said spacer blocks, sliding a plurality of further of said panels at the ceiling of the closed chamber so that said further panels rest on upper edges of the panels covering opposite peripheral walls of said chamber and cover the ceiling of the chamber, inserting spacer blocks between the ceiling of the chamber and said further panels which cover the ceiling of the chamber to stabilize said further panels, applying a supple insulating sheet on the floor of the chamber, and applying still further of said panels on said insulating sheet to cover the floor of said chamber.

11. A method as claimed in claim 10, wherein said still further of said panels are applied on said insulating sheet without affixation.

12. A method as claimed in claim 10, wherein adjacent ones of said panels covering said peripheral walls of the chamber have adjoining edges forming joints, said method further comprising covering said joints with cover strips.

13. A method as claimed in claim 10, wherein adjacent ones of said panels covering the ceiling, peripheral walls and floor of said chamber adjoin one another at right angles forming right-angle corner joints, said method further comprising covering said right-angle corner joints with prefabricated right-angle cover strips.

* * * * *